US007967066B2

(12) United States Patent
McStay et al.

(10) Patent No.: US 7,967,066 B2
(45) Date of Patent: Jun. 28, 2011

(54) METHOD AND APPARATUS FOR CHRISTMAS TREE CONDITION MONITORING

(75) Inventors: Daniel McStay, Aberdeenshire (GB); Aidan Nolan, Fife (GB); Gordon Shiach, Fife (GB); Sean McAvoy, Coatbridge (GB); Espen Rokke, Drammen (NO)

(73) Assignee: FMC Technologies, Inc., Houston, TX (US)

( * ) Notice: Subject to any disclaimer, the term of this patent is extended or adjusted under 35 U.S.C. 154(b) by 414 days.

(21) Appl. No.: 12/118,086

(22) Filed: May 9, 2008

(65) Prior Publication Data

US 2009/0277644 A1 Nov. 12, 2009

(51) Int. Cl.
*E21B 47/00* (2006.01)

(52) U.S. Cl. ..... 166/250.01; 166/336; 166/368; 340/853.1; 340/853.3; 702/6

(58) Field of Classification Search ..... 166/336–339, 166/344, 347, 351, 250.07, 250.08, 250.15, 166/352, 368, 250.01, 250.05; 702/6, 11–13, 702/183, 188; 340/853.1, 853.3, 856.3
See application file for complete search history.

(56) References Cited

U.S. PATENT DOCUMENTS

| | | | | |
|---|---|---|---|---|
| 3,855,456 | A * | 12/1974 | Summers et al. | 700/286 |
| 4,052,703 | A | 10/1977 | Collins, Sr. et al. | 364/200 |
| 4,138,669 | A * | 2/1979 | Edison et al. | 340/3.51 |
| 4,603,735 | A | 8/1986 | Black | 166/68 |
| 4,862,426 | A | 8/1989 | Cassity et al. | 367/81 |
| 5,052,941 | A | 10/1991 | Hernandez-Marti | 439/194 |
| 5,335,730 | A * | 8/1994 | Cotham, III | 166/374 |
| 5,492,017 | A | 2/1996 | Jennings et al. | 73/728 |
| 5,587,707 | A * | 12/1996 | Dickie et al. | 340/870.09 |
| 5,831,743 | A | 11/1998 | Ramos et al. | 356/445 |
| 6,102,124 | A * | 8/2000 | Skeels et al. | 166/347 |
| 6,192,980 | B1 | 2/2001 | Tubel et al. | 166/65.1 |
| 6,257,332 | B1 * | 7/2001 | Vidrine et al. | 166/250.15 |
| 6,257,549 | B1 * | 7/2001 | Hopper | 251/129.11 |
| 6,302,203 | B1 | 10/2001 | Rayssiguier et al. | 166/250.01 |
| 6,378,610 | B2 | 4/2002 | Rayssiguier et al. | 166/281 |
| 6,420,976 | B1 * | 7/2002 | Baggs et al. | 340/853.3 |
| 6,434,435 | B1 * | 8/2002 | Tubel et al. | 700/30 |
| 6,478,087 | B2 * | 11/2002 | Allen | 166/255.1 |
| 6,513,596 | B2 * | 2/2003 | Wester | 166/336 |

(Continued)

FOREIGN PATENT DOCUMENTS

GB 2 182 180 A 5/1987

(Continued)

OTHER PUBLICATIONS

PCT Search Report and Written Opinion from PCT/US2009/054999 dated Dec. 9, 2009.

(Continued)

*Primary Examiner* — Thomas A Beach
*Assistant Examiner* — Matthew R Buck
(74) *Attorney, Agent, or Firm* — Williams, Morgan & Amerson, P.C.

(57) ABSTRACT

A method for monitoring a Christmas tree assembly installed on a subsea hydrocarbon well includes receiving a plurality of parameters associated with the Christmas tree assembly. A health metric for the Christmas tree assembly is determined based on the parameters. A problem condition with the Christmas tree assembly is identified based on the determined health metric.

25 Claims, 5 Drawing Sheets

U.S. PATENT DOCUMENTS

| | | | | |
|---|---|---|---|---|
| 6,561,268 | B2 | 5/2003 | Jones | 166/65.1 |
| 6,564,872 | B2 * | 5/2003 | Davey et al. | 166/344 |
| 6,595,487 | B2 * | 7/2003 | Johansen et al. | 251/129.04 |
| 6,644,848 | B1 * | 11/2003 | Clayton et al. | 374/7 |
| 6,681,861 | B2 | 1/2004 | Davidson et al. | 166/382 |
| 6,725,924 | B2 * | 4/2004 | Davidson et al. | 166/250.01 |
| 6,776,230 | B2 | 8/2004 | Collie et al. | 166/97.1 |
| 6,795,798 | B2 | 9/2004 | Eryurek et al. | 702/188 |
| 6,801,135 | B2 | 10/2004 | Schultz et al. | 340/853.1 |
| 6,817,418 | B2 * | 11/2004 | Gatherar et al. | 166/368 |
| 6,899,178 | B2 | 5/2005 | Tubel | 166/313 |
| 6,913,079 | B2 | 7/2005 | Tubel | 166/250.01 |
| 6,978,210 | B1 * | 12/2005 | Suter et al. | 702/13 |
| 6,980,929 | B2 | 12/2005 | Aronstam et al. | 702/188 |
| 6,994,162 | B2 | 2/2006 | Robison | 166/250.01 |
| 6,998,724 | B2 * | 2/2006 | Johansen et al. | 290/1 R |
| 7,000,698 | B2 | 2/2006 | Mayeu et al. | 166/255.1 |
| 7,011,155 | B2 | 3/2006 | Meister et al. | 166/250.01 |
| 7,074,064 | B2 | 7/2006 | Wallace | 439/190 |
| 7,083,009 | B2 | 8/2006 | Paluch et al. | 175/59 |
| 7,086,461 | B2 | 8/2006 | Schulze-Beckinghausen | 166/77.53 |
| 7,123,162 | B2 * | 10/2006 | Mackenzie et al. | 340/854.7 |
| 7,148,812 | B2 * | 12/2006 | Baggs | 340/853.7 |
| 7,208,855 | B1 | 4/2007 | Floyd | 310/71 |
| 7,210,856 | B2 | 5/2007 | Ringgenberg | 385/53 |
| 7,219,729 | B2 | 5/2007 | Bostick et al. | 166/250.01 |
| 7,219,730 | B2 | 5/2007 | Tilton et al. | 166/255.1 |
| 7,234,524 | B2 * | 6/2007 | Shaw et al. | 166/304 |
| 7,273,105 | B2 * | 9/2007 | Johansen et al. | 166/336 |
| 7,650,943 | B2 * | 1/2010 | Baggs | 166/341 |
| RE41,173 | E * | 3/2010 | Baggs | 340/853.7 |
| 2002/0018399 | A1 | 2/2002 | Schultz et al. | 367/81 |
| 2004/0045705 | A1 | 3/2004 | Gardner et al. | 166/250.01 |
| 2004/0159430 | A1 | 8/2004 | Baggs | 166/250.15 |
| 2005/0173111 | A1 | 8/2005 | Bostick | 166/250.01 |
| 2006/0036403 | A1 | 2/2006 | Wegerich et al. | 702/183 |
| 2006/0115204 | A1 * | 6/2006 | Marsh et al. | 385/12 |
| 2006/0157254 | A1 | 7/2006 | Baggs | 166/368 |
| 2006/0245469 | A1 * | 11/2006 | Koeniger | 374/208 |
| 2007/0107903 | A1 * | 5/2007 | Baggs | 166/344 |
| 2007/0227740 | A1 | 10/2007 | Fontenette et al. | 166/344 |
| 2007/0283761 | A1 | 12/2007 | Bostick | 73/653 |
| 2008/0023204 | A1 | 1/2008 | Fenton | 166/368 |
| 2008/0166099 | A1 | 7/2008 | Dunphy et al. | 385/138 |
| 2008/0217022 | A1 * | 9/2008 | Deans | 166/338 |

FOREIGN PATENT DOCUMENTS

| | | | |
|---|---|---|---|
| GB | 2 318 815 | A | 5/1998 |
| GB | 2 358 204 | A | 7/2001 |
| GB | 2 396 409 | A | 6/2004 |
| GB | 2396086 | A | 6/2004 |
| GB | 2 398 444 | A | 8/2004 |
| GB | 2 400 621 | A | 10/2004 |
| GB | 2 403 965 | A | 1/2005 |
| WO | WO 99/47788 | | 9/1999 |
| WO | WO 99/60247 | | 11/1999 |
| WO | WO 99/64781 | | 12/1999 |
| WO | WO 2004/007910 | | 1/2004 |
| WO | WO 2005/078233 | | 8/2005 |
| WO | WO 2006/059097 | | 6/2006 |

OTHER PUBLICATIONS

PCT Search Report and Written Opinion from PCT/US2008/063501 dated Feb. 24, 2009.

Shiach et al., "Advanced Feed-Through Ssytems for In-Well Optical Fibre Sensing," *Journal of Physics: Conference Series*, 76:012066, 2007.

* cited by examiner

METHOD AND APPARATUS FOR CHRISTMAS TREE CONDITION MONITORING

CROSS-REFERENCE TO RELATED APPLICATIONS

Not applicable.

BACKGROUND OF THE INVENTION

The disclosed subject matter relates generally to subsea hydrocarbon production and, more particularly, to a subsea Christmas tree with condition monitoring.

In order to control a subsea well, a connection is established between the well and a monitoring and control station. The monitoring and control station may be located on a platform or floating vessel near the subsea installation, or alternatively in a more remote land station. The connection between the control station and the subsea installation is usually established by installing an umbilical between the two points. The umbilical may include hydraulic lines for supplying hydraulic fluid to various hydraulic actuators located on or near the well. The umbilical may also include electrical and or fiber optic lines for supplying electric power and also for communicating control signals and/or well data between the control station and the various monitoring and control devices located on or near the well.

Hydrocarbon production from the subsea well is controlled by a number of valves that are assembled into a unitary structure generally referred to as a Christmas tree. Christmas tree and wellhead systems have the principle functions of providing an interface to the in-well environment, allowing flow regulation and measurement, and permitting intervention on the well or downhole systems during the operational life of the well. The actuation of the valves in the Christmas tree is normally provided using hydraulic fluid to power hydraulic actuators that operate the valves. Hydraulic fluid is normally supplied through an umbilical running from a remote station located on a vessel or platform at the surface.

In addition to the flow control valves and actuators, a number of sensors and detectors are commonly employed in subsea systems to monitor the state of the system and the flow of hydrocarbons from the well. Often a number of sensors, detectors and/or actuators are also located downhole. All these devices are controlled and/or monitored by a dedicated control system, which is usually housed in the remote control module. Control signals and well data are also exchanged through the umbilical.

Conventional Christmas trees typically only have a few sensors designed to provide information on the production process. These sensors fail to provide any information regarding the operation or efficiency of the Christmas tree or wellhead. If a particular sensor fails to operate accurately, it may provide errant information regarding the production process. Uncertainties in the accuracy of the well monitoring and the limited amount of data make it difficult to optimize the production process or to predict impending failures.

This section of this document is intended to introduce various aspects of art that may be related to various aspects of the disclosed subject matter described and/or claimed below. This section provides background information to facilitate a better understanding of the various aspects of the disclosed subject matter. It should be understood that the statements in this section of this document are to be read in this light, and not as admissions of prior art. The disclosed subject matter is directed to overcoming, or at least reducing the effects of, one or more of the problems set forth above.

BRIEF SUMMARY OF THE INVENTION

The following presents a simplified summary of the disclosed subject matter in order to provide a basic understanding of some aspects of the disclosed subject matter. This summary is not an exhaustive overview of the disclosed subject matter. It is not intended to identify key or critical elements of the disclosed subject matter or to delineate the scope of the disclosed subject matter. Its sole purpose is to present some concepts in a simplified form as a prelude to the more detailed description that is discussed later.

One aspect of the disclosed subject matter is seen in a method for monitoring a Christmas tree assembly installed on a subsea hydrocarbon well. The method includes receiving a plurality of parameters associated with the Christmas tree assembly. A health metric for the Christmas tree assembly is determined based on the parameters. A problem condition with the Christmas tree assembly is identified based on the determined health metric.

Another aspect of the disclosed subject matter is seen a system including a Christmas tree assembly mounted to a hydrocarbon well, a plurality of sensors, and a condition monitoring unit. The plurality of sensors is operable to measure a plurality of parameters associated with the Christmas tree assembly. The condition monitoring unit is operable to determine a health metric for the Christmas tree assembly based on the parameters and identify a problem condition with the Christmas tree assembly based on the determined health metric.

BRIEF DESCRIPTION OF THE SEVERAL VIEWS OF THE DRAWINGS

The disclosed subject matter will hereafter be described with reference to the accompanying drawings, wherein like reference numerals denote like elements, and.

Figure 1:
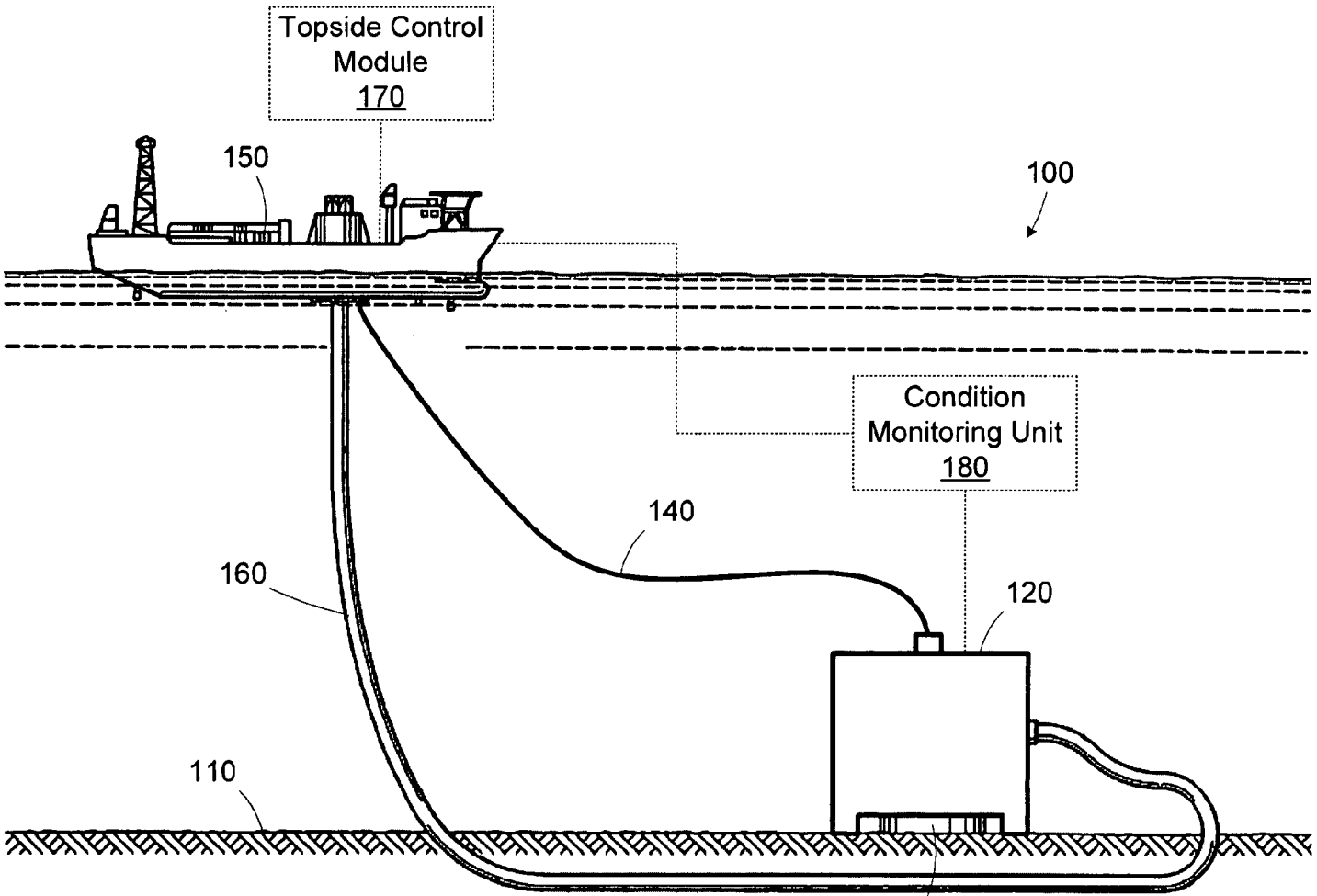
FIG. 1 is a simplified diagram of a subsea installation for hydrocarbon production.

While the disclosed subject matter is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DETAILED DESCRIPTION OF THE INVENTION

One or more specific embodiments of the disclosed subject matter will be described below. It is specifically intended that the disclosed subject matter not be limited to the embodiments and illustrations contained herein, but include modified forms of those embodiments including portions of the embodiments and combinations of elements of different embodiments as come within the scope of the following claims. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the disclosed subject matter unless explicitly indicated as being "critical" or "essential."

The disclosed subject matter will now be described with reference to the attached figures. Various structures, systems and devices are schematically depicted in the drawings for purposes of explanation only and so as to not obscure the disclosed subject matter with details that are well known to those skilled in the art. Nevertheless, the attached drawings are included to describe and explain illustrative examples of the disclosed subject matter. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Referring now to the drawings wherein like reference numbers correspond to similar components throughout the several views and, specifically, referring to FIG. 1, the disclosed subject matter shall be described in the context of a subsea installation 100 located on the seabed 110. The installation 100 includes a schematically depicted Christmas tree 120 mounted on a wellhead 130. The wellhead 130 is the uppermost part of a well (not shown) that extends down into the sea floor to a subterranean hydrocarbon formation. An umbilical cable 140 for communicating electrical signals, fiber optic signals, and/or hydraulic fluid extends from a vessel 150 to the Christmas tree 120. In other embodiments, the vessel 150 may be replaced by a floating platform or other such surface structure. In one illustrative embodiment, a flowline 160 also extends between the vessel 150 and the Christmas tree 120 for receiving hydrocarbon production from the well. In some cases, the flowline 160 and a communications line (not shown) may extend to a subsea manifold or to a land based processing facility. A topside control module (TCM) 170 is housed on the vessel 150 to allow oversight and control of the Christmas tree 120 by an operator. A condition monitoring unit 180 is provided for monitoring the operation of the Christmas tree 120.

Figure 2:
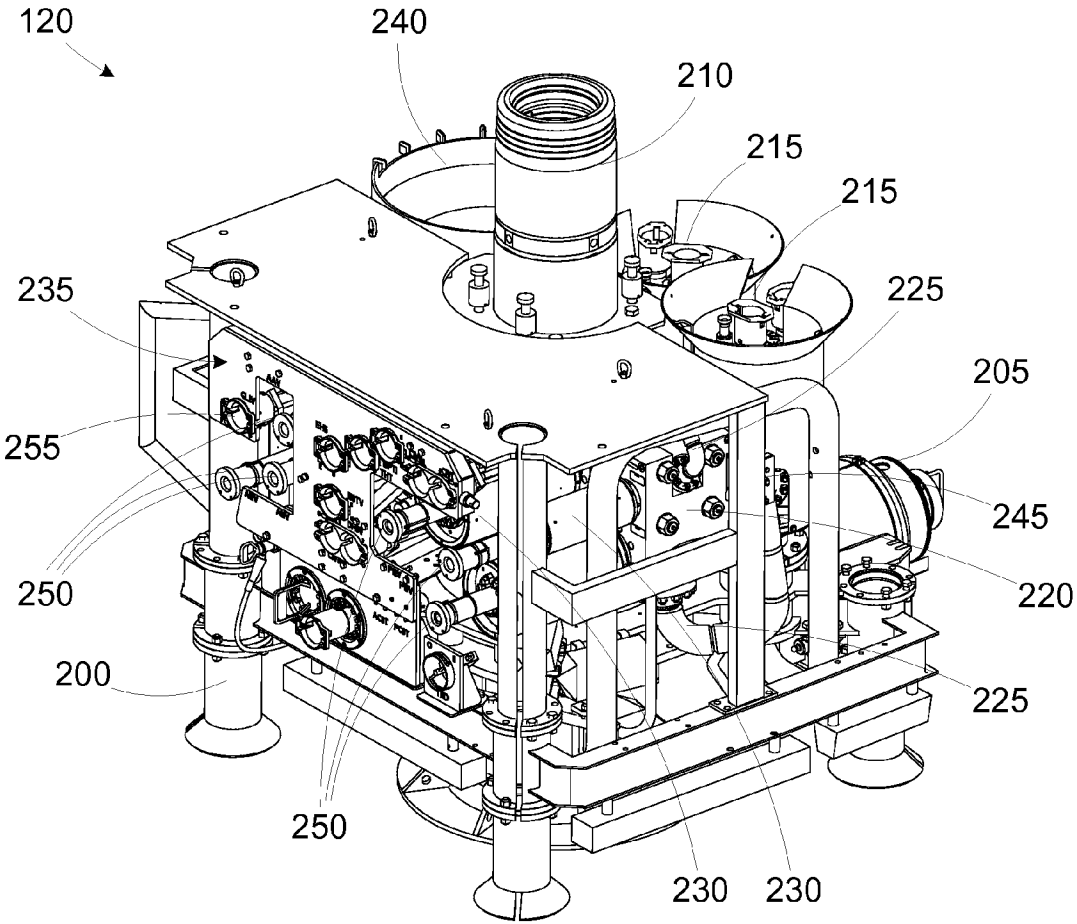
FIG. 2 is a perspective view of an exemplary Christmas tree in the system of FIG. 1.

FIG. 2 illustrates a perspective view of an exemplary Christmas tree 120. The Christmas tree 120 illustrated in FIG. 2 is provided for illustrative purposes, as the application of the present subject matter is not limited to a particular Christmas tree design or structure. The Christmas tree 120 includes a frame 200, a flowline connector 205, a composite valve block assembly 210, chokes 215, a production wing valve 220, flow loops 225, hydraulic actuators 230, a remotely operated vehicle (ROV) panel 235, a subsea control module (SCM) 240, and temperature and pressure sensors 245. Within the ROV panel 235, hydraulic actuator linear overrides 250 and ROV interface buckets 255 are provided for allowing the operation of the actuators 230 or other various valves and components by an ROV (not shown).

The construct and operation of the components in the Christmas tree 120 are well known to those of ordinary skill in the art, so they are not described in detail herein. Generally, the flow of production fluid (e.g., liquid or gas) through the flowline 160 is controlled by the production wing valve 220 and the chokes 215, which are positioned by manipulating the hydraulic actuators 230. The composite valve block assembly 210 provides an interface for the umbilical 140 to allow electrical signals (e.g., power and control) and hydraulic fluid to be communicated between the vessel 150 and the Christmas tree 120. The flow loops 225 and temperature and pressure sensors 245 are provided to allow characteristics of the production fluid to be measured. The subsea control module (SCM) 240 is the control center of the Christmas tree 120, providing control signals for manipulating the various actuators and exchanging sensor data with the topside control module 170 on the vessel 150. The functionality of the condition monitoring unit 180 may be implemented by the topside control module 170 or the subsea control module 240 (i.e., as indicated by the phantom lines in FIG. 1. The condition monitoring unit 180 may be implemented using dedicated hardware in the form of a processor or computer executing software, or the condition monitoring unit 180 may be implemented using software executing on shared computing resources. For example, the condition monitoring unit 180 may be implemented by the same computer that implements the topside control module 170 or the computer that implements the SCM 240.

Generally, the condition monitoring unit 180 monitors various parameters associated with the Christmas tree 120 to determine the "health" of the Christmas tree 120. The health information derived by the Christmas tree 120 includes overall health, component health, component operability, etc. Exemplary parameters that may be monitored include pressure, temperature, flow, vibration, corrosion, displacement, rotation, leak detection, erosion, sand, strain, and production fluid content and composition. To gather data regarding the parameters monitored, various sensors may be employed.

Figure 3:
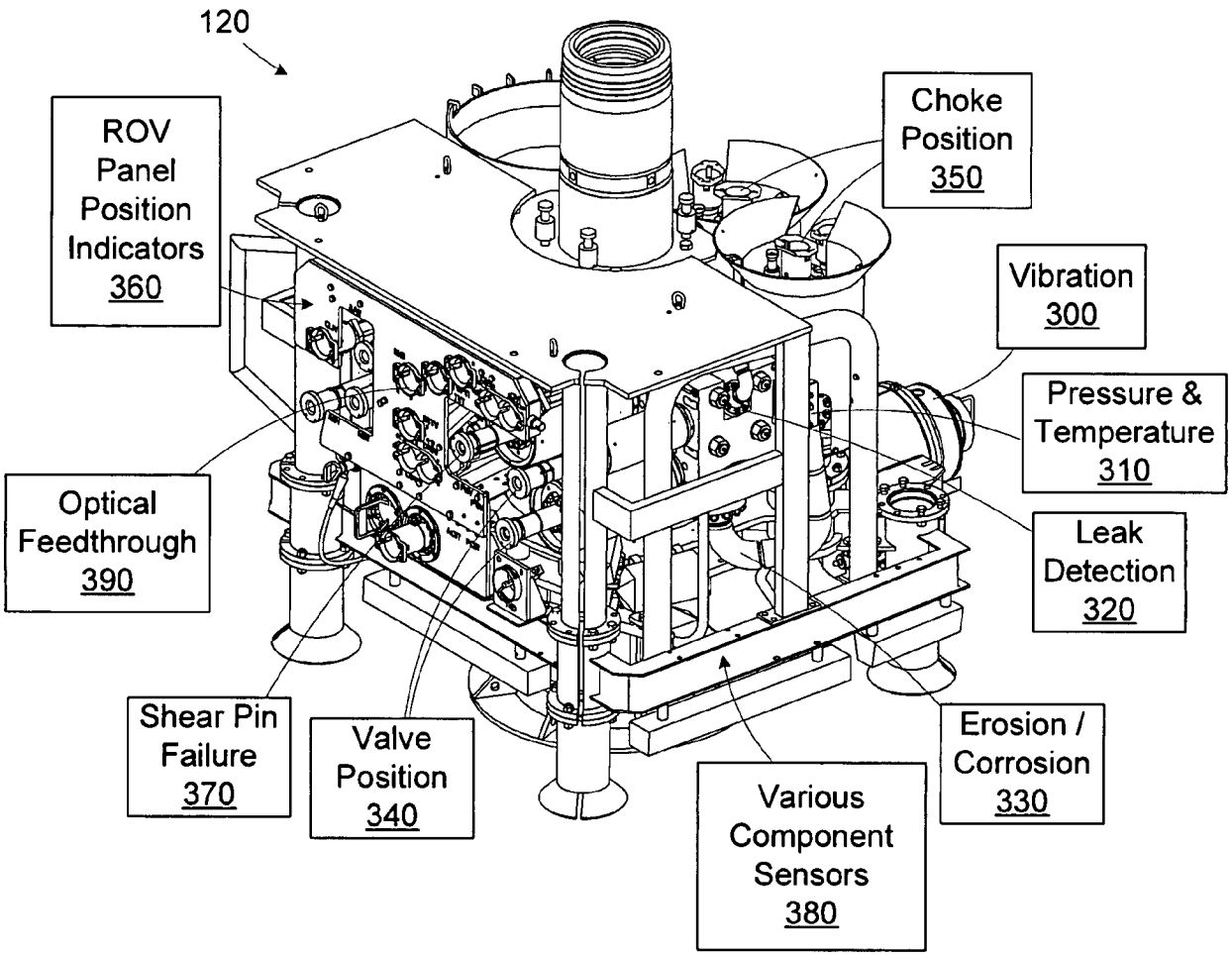
FIG. 3 is a view of the Christmas tree of FIG. 2 illustrating monitoring sensors.

FIG. 3 illustrates a diagram of the Christmas tree 120 showing various illustrative monitoring points. These monitoring points may be provided through the use of optical sensors, an exemplary, but not exhaustive, list of which is provided below. Also, various signals associated with the components (e.g., motor current, voltage, vibration, or noise) may also be considered. As shown in FIG. 3, a vibration sensor 300 may be provided for detecting vibration in the flowline 160. Pressure and temperature sensors 310 may be provided for monitoring the production fluid. One or more leak detection sensors 320 may be provided for monitoring connection integrity. Erosion and/or corrosion sensors 330 may be provided in the flow loops 225. Valve position sensors 340, choke position sensors 350, and ROV panel position indicators 360 may be provided for monitoring the actual valve positions. Shear pin failure sensors 370 may be provided for monitoring the hydraulic actuators 230 and linear overrides 250. Other various component sensors 380 may also be provided for monitoring parameters, such as motor voltage, motor current, pump characteristics, etc. The sensors 300-380 may communicate through an optical feedthrough module 390 to the topside control module 170.

In some embodiments, multiple sensors may be provided for measuring a particular parameter. For example, multiple voltage and current sensors may be provided to allow measurement of standard motor performance voltage and current as well as voltage or current surges, spikes, etc. The duplicate sensors provide both built in redundancy and a means for cross-checking sensor performance.

Figure 4:
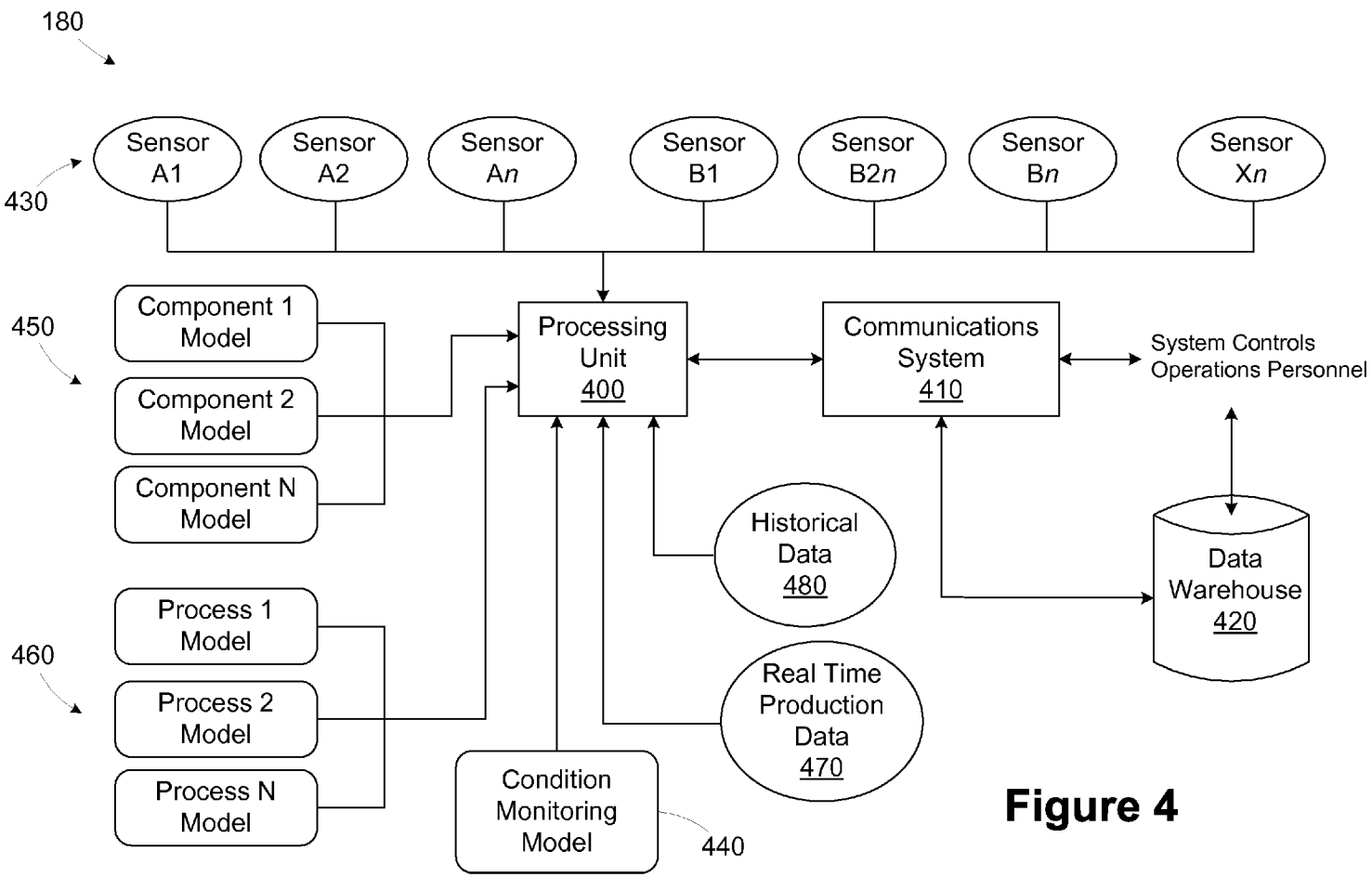
FIG. 4 is a simplified block diagram of a condition monitoring unit in the system of FIG. 1.

FIG. 4 illustrates a simplified block diagram of the condition monitoring unit 180, which includes a processing unit 400, a communications system 410, and a data warehouse 420. The condition monitoring unit 180 operates as a supervisory control and data acquisition (SCADA) system that accesses sensors, models, databases, and control and communications systems, as described in greater detail below. The condition monitoring unit 180 may consider one or more Christmas tree 120 or wellhead 130 related system performance or hydrocarbon production goals and access hydraulic, electronic, or electrical Christmas tree 120 or wellhead 130 control devices to alter the operation of such devices, with minimal human intervention, in accordance with those goals.

The processing unit 400 may be a general purpose computer, such as a microprocessor, or a specialized processing device, such as an application specific integrates circuit (ASIC). The processing unit 400 receives data from a plurality of sensors 430, such as the sensors 300-370 shown in FIG. 3, as well as other data. For example, one of the sensors 430 may provide motor current or voltage data. The processing unit 400 may operate directly on the sensor data in real time or may store the sensor data in the data warehouse 420 through the communications system 410 for offline analysis. Based on the sensor data, the processing unit 400 determines the health of the Christmas tree 120 and or the individual components (e.g., valves, chokes, pumps, etc.). There are various techniques that the processing unit 400 may employ to determine health metrics. In a first embodiment, the processing unit 400 employs a condition monitoring model 440 that directly processes the data from the sensors 430 to determine a health metric. One type of model that may be used to determine a health metric for the Christmas tree 120 is a recursive principal components analysis (RPCA) model. Health metrics are calculated by comparing data for all parameters from the sensors to a model built from known-good data. The model may employ a hierarchy structure where parameters are grouped into related nodes. The sensor nodes are combined to generate higher level nodes. For example, data related to a common component (e.g., valve, pump, or choke) or process (e.g., production flow parameters) may be grouped into a higher level node, and nodes associated with the different components or processes may be further grouped into yet another higher node, leading up to an overall node that reflects the overall health of the Christmas tree 120. The nodes may be weighted based on perceived criticality in the system. Hence, a deviation detected on a component deemed important may be elevated based on the assigned weighting.

For an RPCA technique, as is well known in the art, a metric may be calculated for every node in the hierarchy, and is a positive number that quantitatively measures how far the value of that node is within or outside 2.8-$\sigma$ of the expected distribution. An overall combined index may be used to represent the overall health of the Christmas tree. The nodes of the hierarchy may include an overall node for the Christmas tree 120, multiblocks for parameter groups (e.g., components or processes), and univariates for individual parameters. These overall health metric and all intermediate results plus their residuals may be stored in the data warehouse 420 by the condition monitoring unit 180.

In another embodiment, the processing unit 400 employs one or more component models 450 and/or process models 460 that determine individual health metrics for the various components or the processes being controlled by the Christmas tree 120. The component models 450 may be provided by manufacturers of the particular components used in the Christmas tree 120. The outputs of the lower level health models 450, 460 may be provided to the condition monitoring model 440 for incorporation into an overall health metric for the Christmas tree 120.

The condition monitoring model 440 may also employ data other than the sensor data in determining the intermediate or overall health metrics. For example, real time production data 470 and/or historical data 480 (e.g., regarding production or component operation) may also be employed in the condition monitoring model 440, component models 450, or process models 460. The historical data 480 may be employed to identify trends with a particular component.

The information derived from the condition monitoring model 440 and the nodes at the different hierarchy levels may be employed to troubleshoot current or predicted problems with the Christmas tree 120 or its individual components. The information may also be used to enhance hydrocarbon production by allowing the autonomous adjustment of control parameters to optimize one or more production goals. For example, the condition monitoring unit 180 may communicate to the system controls (i.e., managed by the topside control module 170 and/or subsea control module 240) to automatically adjust one or more production parameters. The information may also be used to provide future operational recommendations for a component or system (e.g., maintenance schedule, load, duty cycle, remaining service life, etc.). Rules based on the determined metrics may be used to facilitate these predictions.

The condition monitoring unit 180 may generate alarms when a particular component or process exceeds an alarm threshold based on the determined health metric. For example, alarm conditions may be defined for one or more nodes in the hierarchy. These alarm conditions may be selected to indicate a deviation from an allowed condition and/or a data trend that predicts an impending deviation, damage, or failure. The alarm condition information may be communicated by the communications system 410 to operations personnel (e.g., visual indicator, electronic message, etc.). The operation personnel may access the data warehouse 420 to gather additional information regarding the particular condition that gave rise to the alarm condition.

In one embodiment, the condition monitoring unit 180 employs the models 440, 450, 460 and/or data from each sensor and associated duplicate sensors to validate the functionality and status of the individual sensor systems or record an error or data offset. The condition monitoring unit 180 may employ adaptive techniques to account for detected variances in the sensor systems. The validated sensor data from a component, such as a choke 215, is used in the condition monitoring model 440 to confirm the functionality and status of the component. This validation enhances the reliability and accuracy of the hydrocarbon production parameters, such as temperature, flow, and pressure of the production fluid.

Figure 5:
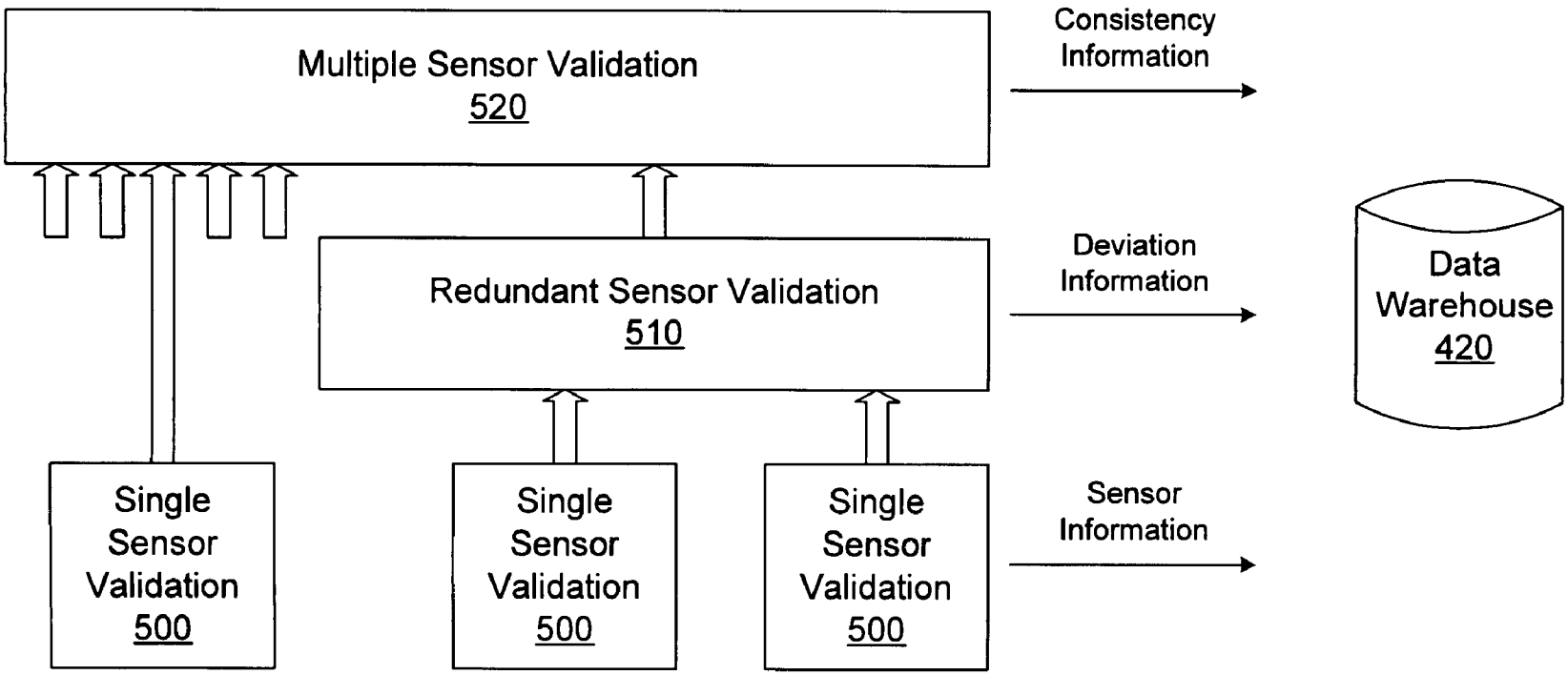
FIG. 5 is a simplified diagram illustrating how multiple or duplicative sensor data may be employed by the condition monitoring unit to identify problem conditions.

FIG. 5 is a simplified diagram illustrating how multiple or duplicative sensor data may be employed by the condition monitoring unit 180 to identify problem conditions. At a first level, single sensor validation 500 may be performed (i.e., sensor values are within permitted ranges. Redundant sensor validation 510 may be conducted at a second level based on the single sensor validation 500 to identify deviation information. For example, two independent sensors may be used to measure the same parameter (e.g., pressure or temperature). Subsequently, multiple sensor validation 520 may be performed by comparing the sensor data from the redundant sensor validation 510 to data from other sources, such as other sensors, that provide an indication of the measured parameter. For example, pressure indications from a pressure sensor may or may not be consistent with expected values resulting from choke or valve position. The deviation and consistency information may be stored in the data warehouse 420. Moreover, the deviation and consistency information may be incorporated into the condition monitoring model 440 for health determination. Individual parameters may be within limits, but when considered from a deviation or consistency perspective, a problem condition may be suggested.

Employing condition monitoring for the Christmas tree 120 and its associated components has numerous advantages. Operation of the well may be optimized. Current and future operability of the components may be determined and maintenance intervals may be determined based on actual component performance.

The particular embodiments disclosed above are illustrative only, as the disclosed subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the disclosed subject matter. Accordingly, the protection sought herein is as set forth in the claims below.

We claim:

1. A method for monitoring a Christmas tree assembly installed on a subsea hydrocarbon well, comprising:

receiving a plurality of parameters associated with the Christmas tree assembly;

determining a health metric for the Christmas tree assembly based on the parameters, wherein the health metric represents a combined measure deviations between the parameters and expected values for the parameters over the plurality of parameters; and identifying a problem condition with the Christmas tree assembly based on the determined health metric.

2. The method of claim 1, further comprising identifying the problem condition responsive to the determined health metric deviating from a predetermined range of acceptable values.

3. The method of claim 1, wherein determining the health metric comprises employing a condition monitoring model of the Christmas tree assembly to evaluate the plurality of parameters.

4. The method of claim 3, further comprising employing the condition monitoring model based on the plurality of parameters and historical data associated with at least one of the parameters.

5. The method of claim 3, further comprising employing the condition monitoring model based on the plurality of parameters and production data associated with the Christmas tree assembly.

6. The method of claim 1, wherein determining the health metric comprises employing at least one component model associated with at least one component of the Christmas tree assembly in generating the health metric.

7. The method of claim 1, wherein determining the health metric comprises employing at least one process model associated with the operation of the Christmas tree assembly in generating the health metric.

8. The method of claim 1, wherein the Christmas tree includes first and second sensors operable to measure a selected one of the parameters, and identifying the problem condition further comprises identifying a deviation condition associated with the first and second sensors.

9. The method of claim 1, wherein the Christmas tree includes a first sensor operable to measure a first characteristic of the Christmas tree assembly and a second sensor operable to measure a second characteristic of the Christmas tree assembly, and identifying the problem condition further comprises identifying that the first characteristics is inconsistent with the second characteristic.

10. The method of claim 1, further comprising communicating the problem condition to an operator of the Christmas tree assembly.

11. The method of claim 1, wherein the Christmas tree assembly comprises a valve, and at least one of the parameters is associated with a position of the valve.

12. The method of claim 1, wherein the Christmas tree assembly is operable to control flow of a hydrocarbon fluid, and at least one of the parameters is associated with a parameter of the hydrocarbon fluid.

13. A system, comprising:

a Christmas tree assembly mounted to a hydrocarbon well;

a plurality of sensors operable to measure a plurality of parameters associated with the Christmas tree assembly; and a condition monitoring unit operable to determine a health metric for the Christmas tree assembly based on the parameters and identify a problem condition with the Christmas tree assembly based on the determined health metric, wherein the health metric represents a combined measure of deviations between the parameters and expected values for the parameters over the plurality of parameters.

14. The system of claim 13, wherein the condition monitoring unit is operable to identify the problem condition responsive to the determined health metric deviating from a predetermined range.

15. The system of claim 13, wherein the condition monitoring unit is operable to employ a condition monitoring model of the Christmas tree assembly to evaluate the plurality of parameters.

16. The system of claim 15, wherein the condition monitoring unit is operable to employ the condition monitoring model based on the plurality of parameters and historical data associated with at least one of the parameters.

17. The system of claim 15, wherein the condition monitoring unit is operable to employ the condition monitoring model based on the plurality of parameters and production data associated with the Christmas tree assembly.

18. The system of claim 13, wherein the condition monitoring unit is operable to employ at least one component model associated with at least one component of the Christmas tree assembly in generating the health metric.

19. The system of claim 13, wherein the condition monitoring unit is operable to employ at least one process model associated with the operation of the Christmas tree assembly in generating the health metric.

20. The system of claim 13, wherein the Christmas tree includes first and second sensors operable to measure a selected one of the parameters, and the condition monitoring unit is operable to identify a deviation condition associated with the first and second sensors.

21. The system of claim 13, wherein the Christmas tree includes a first sensor operable to measure a first characteristic of the Christmas tree assembly and a second sensor operable to measure a second characteristic of the Christmas tree assembly, and the condition monitoring unit is operable to identify that the first characteristics is inconsistent with the second characteristic.

22. The system of claim 13, wherein the condition monitoring unit is operable to communicate the problem condition to an operator of the Christmas tree assembly.

23. The system of claim 13, wherein at least one of the sensors comprises a vibration sensor, a corrosion sensor, an erosion sensor, or a leak detection sensor.

24. The system of claim 13, wherein the Christmas tree assembly comprises a valve, and at least one of the sensors is associated with a position of the valve.

25. The system of claim 13, wherein the Christmas tree assembly is operable to control flow of a hydrocarbon fluid, and at least one of the sensors is operable to measure a parameter of the hydrocarbon fluid.

* * * * *

UNITED STATES PATENT AND TRADEMARK OFFICE

CERTIFICATE OF CORRECTION

PATENT NO. : 7,967,066 B2
APPLICATION NO. : 12/118086
DATED : June 28, 2011
INVENTOR(S) : Daniel McStay et al.

It is certified that error appears in the above-identified patent and that said Letters Patent is hereby corrected as shown below:

Col. 7, line 43 (claim 1, line 7), after “measure” insert -- of --.

Signed and Sealed this
Ninth Day of August, 2011

David J. Kappos

David J. Kappos
*Director of the United States Patent and Trademark Office*